US012402729B2

(12) United States Patent
Nguyen

(10) Patent No.: US 12,402,729 B2
(45) Date of Patent: Sep. 2, 2025

(54) MATTRESS ASSEMBLY AND METHOD OF MAKING SAME

(71) Applicant: Loc Van Nguyen, Houston, TX (US)

(72) Inventor: Loc Van Nguyen, Houston, TX (US)

( * ) Notice: Subject to any disclaimer, the term of this patent is extended or adjusted under 35 U.S.C. 154(b) by 0 days.

(21) Appl. No.: 18/411,317

(22) Filed: Jan. 12, 2024

(65) Prior Publication Data

US 2024/0251957 A1 Aug. 1, 2024

Related U.S. Application Data

(63) Continuation of application No. 17/164,626, filed on Feb. 1, 2021, now Pat. No. 11,896,135.

(60) Provisional application No. 63/047,105, filed on Jul. 1, 2020.

(51) Int. Cl.
*A47C 27/00* (2006.01)
*A47C 27/15* (2006.01)

(52) U.S. Cl.
CPC ..... *A47C 27/002* (2013.01); *A47C 27/15* (2013.01)

(58) Field of Classification Search
CPC ..... A47C 27/002; A47C 27/15; A47C 31/105; A47C 27/056; A47C 27/003; A47G 9/0246; A47G 9/04; A47G 9/0238; A47G 9/02
See application file for complete search history.

(56) References Cited

U.S. PATENT DOCUMENTS

| | | | | |
|---|---|---|---|---|
| 4,067,269 | A | 1/1978 | Fanghanel | |
| 5,497,718 | A | 3/1996 | Cash | |
| 5,970,543 | A | 10/1999 | Barreca et al. | |
| 6,263,532 | B1 | 7/2001 | Miller | |
| 6,994,043 | B1 | 2/2006 | Price | |
| 7,647,876 | B2 | 1/2010 | Oxley et al. | |
| 8,181,293 | B2 | 5/2012 | DeFranks et al. | |
| 10,413,082 | B2 | 9/2019 | Lava et al. | |
| 2014/0068868 | A1* | 3/2014 | Morzano | A47G 9/00 5/493 |
| 2014/0096325 | A1 | 4/2014 | Giannopoulos | |
| 2016/0157625 | A1 | 6/2016 | Schneider et al. | |
| 2017/0112293 | A1* | 4/2017 | Battaglia | A47C 27/04 |
| 2019/0298078 | A1 | 10/2019 | Vester, III et al. | |
| 2019/0350376 | A1* | 11/2019 | Kittaneh | A47C 31/105 |
| 2020/0323358 | A1* | 10/2020 | Zampollo | A47C 31/105 |

(Continued)

FOREIGN PATENT DOCUMENTS

| | | | |
|---|---|---|---|
| CN | 107007069 | A | 8/2017 |
| KR | 20140095716 | A | 8/2014 |

OTHER PUBLICATIONS

International Search Report and Written Opinion mailed Oct. 6, 2021, issued in PCT Application No. PCT/US2021/039914. [15 pages].

(Continued)

*Primary Examiner* — Justin C Mikowski
*Assistant Examiner* — Alison N Labarge
(74) *Attorney, Agent, or Firm* — Alberto Q. Amatong, Jr.; Amatong McCoy LLC

(57) ABSTRACT

Described herein is a method of forming a mattress (and product thereof) including providing a cover-top panel compact that includes a top panel having one or more filler layers and a drape that is affixed to the top panel at a first margin. The method entails detaching the drape at a second margin and inverting the drape to engage a supporting core, thereby completing the mattress assembly.

22 Claims, 10 Drawing Sheets

(56) References Cited

U.S. PATENT DOCUMENTS

| | | | | |
|---|---|---|---|---|
| 2021/0235884 | A1 | 8/2021 | Nolte et al. | |
| 2021/0244209 | A1 | 8/2021 | Craft | |
| 2021/0251391 | A1* | 8/2021 | Wagner ..... | B65D 75/002 |

OTHER PUBLICATIONS

Machine translation of KR20140095716 cited in International Search Report and Written Opinion mailed Oct. 6, 2021, issued in PCT Application No. PCT/US2021/039914. [4 pages].

* cited by examiner

MATTRESS ASSEMBLY AND METHOD OF MAKING SAME

CROSS-REFERENCE TO RELATED APPLICATION

The present application is a Continuation of U.S. patent application Ser. No. 17/164,626, filed on Feb. 1, 2021 (now U.S. Pat. No. 11,896,135), entitled "MATTRESS ASSEMBLY, SUBASSEMBLY, OR COMPONENTS THEREOF, AND METHOD OF MAKING SAME" and claims the benefit of U.S. Provisional Patent Application No. 63/047,105, filed on Jul. 1, 2020, entitled "MATTRESS ASSEMBLY AND METHOD OF MAKING SAME", the entirety of which is incorporated herein by reference.

FIELD

The present disclosure relates generally to a method of assembling a multi-component textile-supplemented furnishing construct, as well as to the finished product and structural components thereof. The present disclosure is particularly applicable to the assembly of a furniture construct that incorporates a textile component, such as a mattress or mattress assembly.

BACKGROUND

In the field of manufacturing furnishing constructs such as furniture and more particularly, mattresses and cushioned and/or material-layered assemblies, certain operations and techniques are labor-extensive and/or require skilled workers. Other operations and techniques which have traditionally been performed manually, may now be performed, in the alternative, with the aid of specialized machines. These machines can be complex, however, and usually require operation by a skilled operator. Examples include prior art techniques of closing layered edges by applying a tape edge. See e.g., the techniques discussed in U.S. Pat. Nos. 7,647,876, 6,994,043, and 5,432,964.

There is a need for improvements in the design (and assembly) of such furnishing constructs, including furniture and mattresses, which directly or indirectly, increases the efficiency, productivity, cost, ease of manufacture, assembly, shipping, storage, and maintenance, as well as product quality and appeal.

BRIEF SUMMARY

The present disclosure describes methods, techniques, products, systems/apparatus, and assemblies that present improvements and enhancement to the field of furnishings, furniture, textile, and their manufacture, and the like. These improvements are particularly applicable to textile-supplemented or supported furniture and furnishings and, more particularly, to bedding products including mattresses, pillowtop assemblies, and the like.

The present disclosure describes, among other concepts, a method of forming a mattress including providing a cover-top panel compact that includes a top panel having one or more filler layers and a drape that is affixed to the top panel at a first margin. The method entails inverting the drape to engage a supporting core, thereby completing the mattress assembly. In one variation, the method includes first securing the drape about the top panel and/or detaching the drape at a second margin. In another variation, the detaching step includes opening the drape to detach the second margin and/or fastening the second margin to enclose the core. In yet another variation, the detaching step is preceded by detachably fastening the drape at the second margin to enclose or cover the top panel.

The present disclosure describes a mattress assembly including a supporting core and a subassembly including a plurality of filler layers secured within a layered cushion panel and a drape extending from the panel. The subassembly may be called a cover assembly, a core cover-top panel compact, a top panel assembly, a fitted cushion assembly, and the like. The subassembly further includes a drape with a skirt secured about sidewalls of the core. Removed from the subassembly, the drape preferably has a continuous first margin and a continuous second margin, and all-around (continuous) sidewalls extending therebetween. The continuous margins are, of course, preferably rectangular so as to accommodate a rectangular core and top panels. The first margin is preferably enclosed by affixing at an interface with the cushioned panel. The second margin is sometimes referred to as a free or detachable margin, and is closeable above the cushion panel (e.g., by using a zipper to unite the margin).

The present disclosure also describes a method of forming a mattress including providing a top panel or cover assembly including a top panel having one or more filler layers and a drape fixed to the top panel, and juxtaposing the cover assembly with a supporting core having a topside, an underside, and sidewalls therebetween. The method further includes extending the drape to integrate the core with the cover assembly to form a mattress. Alternatively, the method may include inverting the drape to integrate the core with the top panel to form a mattress. In one variation, the method specifically entails opening the drape and then inverting the drape, while fixed to the top panel, such that the drape receives the core. In further variations, the method also includes closing the drape to encase the core. In still further variations, a cover assembly is provided having a core and a drape fixed thereto, and the drape is extended or inverted to integrate a top panel, to form a mattress assembly. Preferably, the drape is situated, initially, so as to enwrap sidewalls of the top panel (e.g., by way of a fitted border skirt), but is removable therefrom, and then, situated about sidewalls of the core to enwrap the sidewalls of the core.

The present disclosure also pertains to a mattress assembly having a support core mattress component including a core having a topside, underside, and all-around side construction therebetween and a top panel or pillowtop assembly including a plurality of filler layers secured within a layered cushion panel. The first mattress components further include a drape having a fixed margin secured to that first component, and a free margin secured to the second of the mattress components. In further variations, the drape is invertible and/or closeable to receive the second mattress component.

The present disclosure also pertains to a mattress assembly including a top panel subassembly or cover assembly for engagement with a support core to complete a mattress assembly. The top panel subassembly includes a top panel containing a plurality of filler layers, and has a topside, an underside, and an all-around cover facing extending between a perimeter of the topside and a perimeter of the underside. The subassembly also includes a drape extending from the panel proximate the perimeter of the underside toward the topside and detachably fastened thereabout.

The present disclosure also pertains to a method of forming a mattress including providing a cover-cushion compact. The compact includes a top panel having one or more filler layers and a detachably fastened drape affixed to the top panel. The method entails detachably fastening free sections of the drape to enclose the drape about the top panel, and detaching the free sections to open the drape. The method then includes inverting the drape such that the free sections engage a supporting core, thereby completing the mattress assembly. Further, the step of providing may include providing a drape having a first end defined by a first margin and a second end defined by a second margin, the drape having continuous sidewalls extending between the margins. Thus, the drape is situated such that the first margin enwraps the top panel and is second margin is closed such that the drape encloses at least a topside and sidewalls of the top panel.

In another aspect, a method is described for forming a mattress including providing a cover-cushion compact. The compact includes a top panel having one or more filler layers and a drape affixed to the top panel about a first margin and secured outboard of the first margin about the top panel. The method further includes disengaging the drape from about the panel, and while remaining affixed to the top panel about a first margin, extending the drape to engage a supporting core, thereby completing the mattress assembly. Engaging a core may include securing the drape about the core or further, encasing the core with the compact. The method may also entail detachably fastening sections of the drape, outboard of said first margin, to enclose the drape about the top panel and/or detaching the fastening sections to open the drape. Extending the drape may include inverting the drape to engage the core and, further, securing the drape about the core. Notably, the first margin may be affixed to the top panel at a fixed edge and, thus, inverting may include pivoting the drape about the fixed edge. Inverting may further include encasing the core and/or receiving the core in a compartment defined by the compact.

In another aspect, an unassembled mattress system is described including a support core having a topside, underside, and all-around side construction therebetween and a cover assembly including a plurality of filler layers and drape. The cover assembly is secured within a layered cushion panel and the drape has a fixed margin secured to the panel and a second margin secured about the panel. The cover assembly is alignable with the core such that the drape is detachable at the second margin and movable about the first margin to secure the core.

In another aspect, a method of assembling a mattress is described having a cover assembly including a plurality of filler layers secured within a layered cushion panel and a drape having a fixed margin secured to the panel and a second margin secured about the panel. The method further includes aligning the cover assembly with a supporting core and deploying the drape to integrate the core with the cover assembly. Deploying includes disengaging a margin of the drape from about the panel and moving the drape to engage the core, thereby completing the mattress assembly. Deploying may further include inverting the drape so as to engage the core and/or engaging the core with the drape to receive the core in a compartment defined, at least partially, by the cover assembly. Furthermore, the drape may be closed about the panel and deploying the drape is preceded by opening the drape. As well, deploying the drape may be followed by closing the drape about the core.

In certain preferred applications, the drape includes a border skirt, and providing the compact includes supporting the border skirt about the top panel and inverting includes pivoting the border skirt toward the core. said inverting includes pivoting said border skirt to said core and supporting said border skirt about the core. Furthermore, the top panel may include a topside and sidewalls, and providing the compact may include situating the drape about the panel such that the compact covers the sidewalls and topside of the top panel. The compact may be affixed to the top panel about a first tape edge and the top panel further includes a second tape edge and the drape includes a third tape edge, and, then, engaging the core is preceded by pivoting the compact about the first tape edge toward the core so as to reveal the second tape edge, and dispose the third tape edge about a perimeter of the core. The method may further provide a drape having a first end defined by the first margin and a second end defined by a second margin, and the drape has continuous sidewalls extending between the margins. In this case, the drape is situated such that the first margin enwraps the top panel and the second margin is closed such that the drape encloses at least a topside and sidewalls of the top panel. Next, engaging the core may include pivoting the drape away from the top panel and toward and about the core to substantially encase the core. Further, the drape and the panel together may include at least two tape edges, such that the method includes covering (during detachably fastening) the at least two tape edges, and uncovering the tape edges during engaging the core. Alternatively, the drape and the panel together may include at least three tape edges, and the detachably fastening step includes pivoting the drape toward the panel such that at least two of the tape edges are covered. Further, each of the drape and the top panel may include at least one tape edge, such that the detachably fastening step includes covering the at least one tape edges, and engaging the core is preceded by uncovering the at least one tape edges by moving the drape about the fixed margin and away from the top panel. Further yet, the drape and the top panel share at least a first tape edge and each of the drape and top panel further includes another tape edge, such the detachably fastening step includes covering these tape edges and engaging the core is preceded by uncovering these tape edges by moving the drape about the fixed margin and away from the top panel.

BRIEF DESCRIPTION OF THE DRAWINGS

So that the manner in which the features and advantages of the system, apparatus, products, and/or methods so of the present disclosure may be understood in more detail, a more particular description briefly summarized above may be had by reference to specific implementation of the method and mattress product that are illustrated in the appended drawings. It is to be noted, however, that the drawings illustrate specific implementations for illustration and are therefore not to be considered limiting of the disclosed concepts as it may include other, effective application as well. It is noted, in particular, that the exemplary applications described herein describe certain top panel or pillowtop assemblies of filler layers and quilted panels, and a supporting core of a general construction and employing generic support element described as spring, foam, or combinations thereof. These specific constructions and more detailed variations thereof are not limiting of the concepts. The concepts described herein contemplate the use of most known mattress constructions and components, noting as well that certain applications may employ less than all of the different aspects described below.

Figure 1:
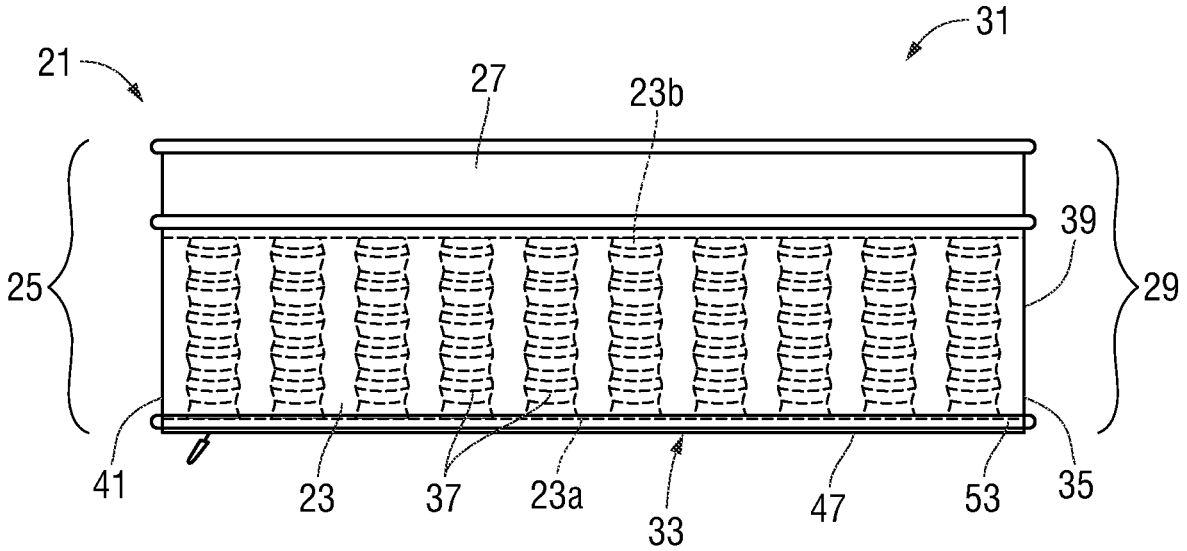
FIG. 1 is a simplified illustration in elevation view of a complete, finished mattress according to the present description.

A conventional mattress, to which the present description of enhancements and improvements are applicable, generally includes a support core, padding or pillowtop section (referred to herein as "top panel" or "top panel assembly"), and a cover assembly. The padding may be provided atop and beneath the core, but for present purposes and so as to facilitate description, only a top padding may be specified. The top panel may comprise a plurality of layers or components, including a number of cushion layers, quilted panels, fabrics, and insulators, as generally known in the art (sometimes referred to herein, collectively as "fillers" or "layers"). Preferred or common filler materials include foam, latex, micro-pocket, or some combination of these materials. The enhancements or improvements described herein are, of course, well suited to accommodate common fillers and filler accommodations generally known in the art.

The cover assembly is typically equipped with an annular border skirt (usually fabric, but sometimes foam or foam and fabric) attached to, and extendible downward (when fitted) from, the perimeter (or thereabout) of the panel. For present purposes, the term annular is used to refer to a body defined by opposite ends or margins and walls or sidewalls extending therebetween having a continuous transverse dimension transverse. Thus, the annular object is not limited by a circular or circumferential, or diametric dimension or property. The border skirt is fitted over all-around sidewalls of the core and assists, in some applications, to hold the top panel in place relative to the core. The border skirt may be described, in this respect, as being enwrapped about the sidewall of the top panel. As used herein, the term "sidewall" refers to the all-around vertical, construction provided between a topside and underside of the core and presented and visible outward of the core. The "sidewall" (or "side" or "side construction") may or may not present an actual planar surface but in the finished mattress, the sidewall supports a facing, fabric, border, skirt, or other solid surface. In some instances, the core will, initially, have less than a full or substantial covering the support elements (e.g., spring or foam) about the side construction, but will have sufficient structure to later support a border skirt or some other covering. Similarly, the core may be describe as having a "topside" and "underside", which are outward facing constructions that may or may not include facing, fabric, border, skirt, or a solid, continuous or uniform surface. Preferably, the underside and topside are provided with a fabric that cover a significant portion of an arrangement of support elements such as spring, foam, some combination of spring and foam, and the like.

The border skirt also presents an aesthetically appropriate outer covering for the core (when fitted) and, thereby, the mattress. The border skirt preferably matches the width of the core's sidewall. Various fasteners may be employed for securing the free edges of the border skirt to secure the skirt about the sidewalls and preferably seal the core and mattress.

Typically, commercially-preferred support cores employ spring elements, foam element(s), or a combination of both to impart the structural integrity, softness, and comfort properties desired. Core constructions suited for incorporation with the mattress of the present description may be of any such construction, as generally known and commonly used in the art. To facilitate the present description, a core employing primarily spring elements is referred to and depicted.

Figure 2:
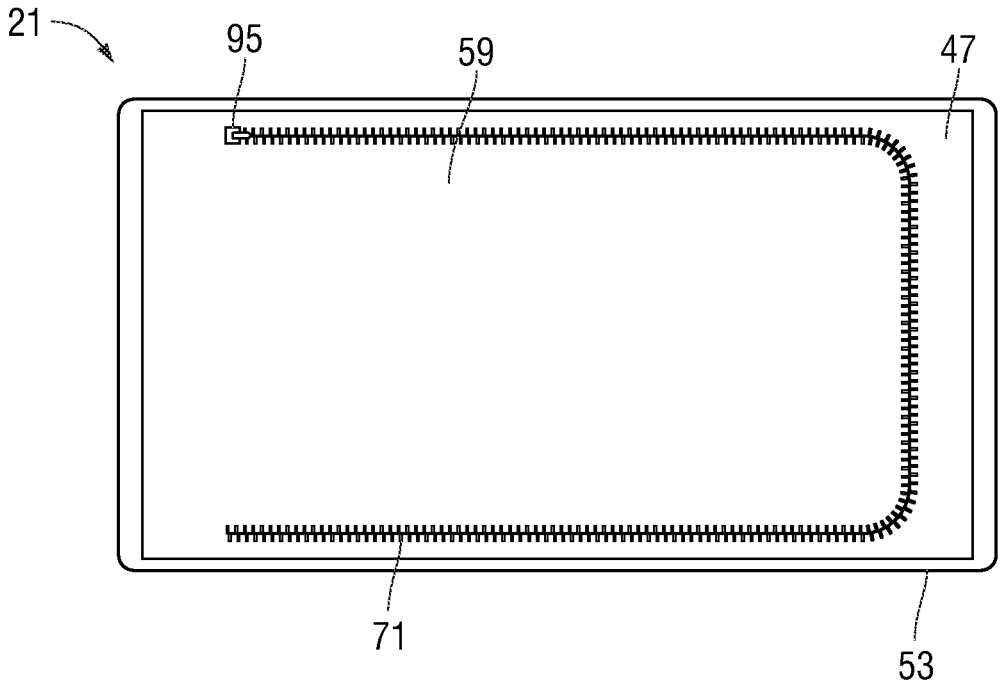
FIG. 2 is a bottom view of the mattress in FIG. 1.
Figure 3:
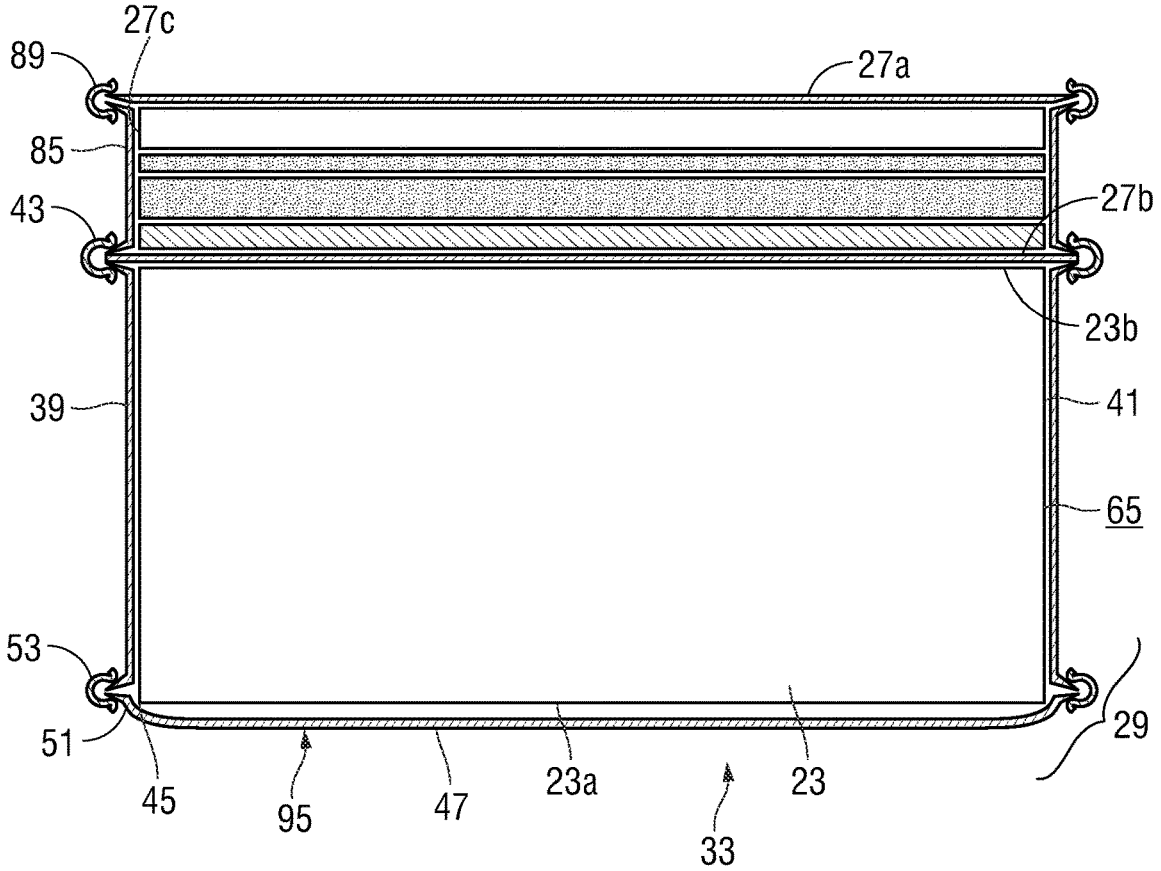
FIG. 3 is a cross-sectional view of the mattress in FIG. 1.

Referring now to FIGS. 1-3, a mattress 21 in accordance with the present description is an integrated structure that may include or consist of a core 23 constructed of an array of supporting elements 37 (e.g., springs, foam structures, and the like, and combinations thereof) and a cover or cushion assembly 25 integrated (e.g. attached, adjoined, encompassing, encasing, or enclosing) with the core 23. The core 23 is further described herein as having a bottom surface 23*a*, an opposite-facing top side or top surface 23*b*, and all-around sidewalls or side construction 41 extending vertically therebetween. In some designs or configurations, the core bottom face 23*a* also forms at least a part, if not much of the finished mattress assembly's underside 33.

The cover assembly 25 is described as having two components or sections: a pillowtop or top panel 27 and a drape 29 preferably affixed to the top panel 27 about a perimeter (or thereabout) of the panel 27. As the mattress 21 is preferably configured in fitted and finished fashion, the top panel 27 is supported atop the core 23 and aligned therewith, such that the cover assembly 25 and core 23 form a rectangular prism body (or cuboid) with a top face 31, a bottom face 33 (or underside 33), and four sidewalls 35. To facilitate description, the top panel 27 is referred to as having a panel top 27*a*, an opposite-facing panel bottom 27*b*, and all-around sidewalls 27*c* extending therebetween.

In a preferred, finished configuration, the cover assembly 25 generally covers and obscure, from view, all or much of the core 23, although optional appurtenances and decorative pieces or sections may also be used to effect design and structural considerations. Appurtenances and the like notwithstanding, the mattress 21 or mattress assembly 21 is referred to, in the present description, as a two-piece mattress 21 with a top panel 27 that includes a sub-assembly of filler materials and a border skirt 39 extendable therefrom. The cover assembly 25 and core 23 are deemed integrated when the cover assembly 25 is secured to or about the core 23 to provide an outer structural cover to the mattress 23. In further variations, as described below and illustrated in FIG. 1, the cover assembly 25 (or a section or part thereof) encompasses, subsumes, or encases the core 23, preferably within a defined compartment.

Figure 3A:
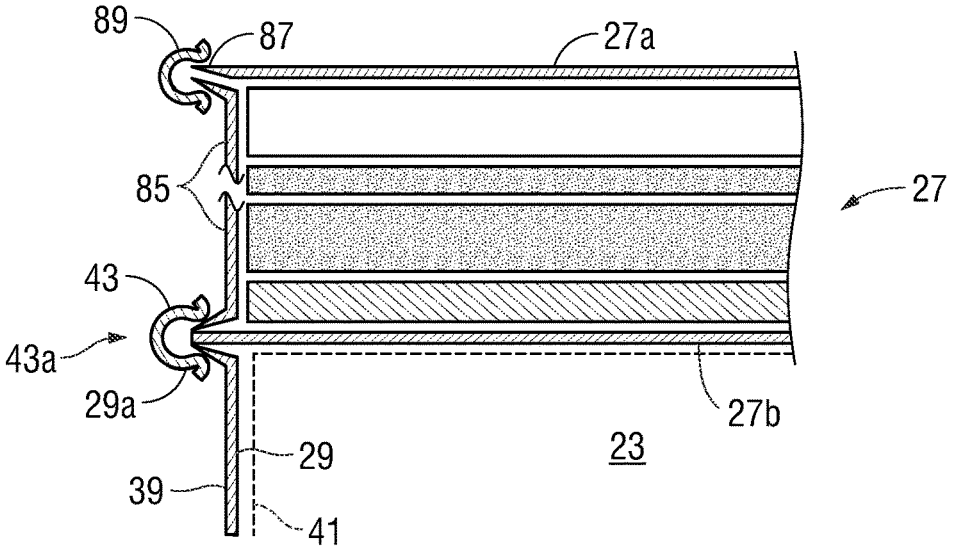
FIG. 3A is a simplified and exaggerated detail cross-sectional view of a multi-component interface(s) in the mattress of FIG. 3.

Referring specifically to the cross-sectional view and illustration of the cover assembly 25 in FIGS. 3 and 3A, the drape 29 has a fixed end or margin 29*a* affixed near or about the (bottom) perimeter of the top panel 27. In this design, the fixed margin 29*a* is closed and extends about and tracks (horizontal edge) the perimeter of the generally rectangular bottom 27*b* of the top panel 27. The top panel 27 is actually situated within the opening otherwise defined by the fixed margin 29*a* of the drape, thereby closing the drape 29. See also FIG. 1. The fitted drape 29 extends downward from the top panel 27 and along vertically-extending sidewall construction 41 (sidewalls 41) of the core 23. The fixed margin 29*a* may be attached or affixed to a flange or tape edge construction 43*a* (or, simply tape edge 43), or attached inboard of the perimeter and attached by sewing, staple, and other conventional means. The drape 29 extends past a bottom perimeter edge 45 of the core 23, and preferably tucks inwardly from there to fit the underside 33 of the core 23.

The tape edge 43*a* also closes the bottom edge of a vertical facing or gusset 85. As shown in FIG. 3A, the gusset 85 covers the edges of multiple filler layers and panels that are contained within the top panel 27. At an interface 87 of a top margin of the gusset 85 and the perimeter of panel top 27*a*, another tape edge 89 is employed to close the perimeter edges. While the gusset 85, panel top 27*a*, and tape edge 89 together impart structural integrity on the multi-component construction, these components also present a decorative or finished facing for the finished mattress assembly 21. (In other designs, the interface is replaced by cover material extending (with or without a seam or reinforcement) from above the panel and downward the tape edge construction 43*a*, thereby eliminating the taper edge 87).

The drape 29 has two principal sections: the border skirt 39 and an underside cover 47. As shown, the border skirt 39 (or simply, border 39) is preferably an all-around (closed) band that extends vertically along and beyond, the core sidewalls 41 and thereby, presents the side faces of the finished mattress 21. Accordingly, the border skirt 39 is preferably made of a decorative fabric, or foam, or a foam-fabric hybrid. The border skirt 39 is also dimensioned to match those of the mattress core 23 and, as necessary, imparted with sufficient slack and elasticity (e.g., at the bottom margin or interface with the underside cover 47) to ease assembly and ensure fit.

Preferably, the drape 29 includes the underside cover 47—a section of fabric extendable inwardly of the border skirt 39 and sidewalls 41. Obscured from view in the finished mattress assembly, the underside cover 47 may be of a lighter fabric or netting with sufficient length or extension from the border skirt 39 for placement beyond the bottom perimeter edge 45 of the core 23. In preferred designs, the interface 51 between the border skirt 39 and the cover 47 is provided by a tape edge 53, as shown in FIG. 3 (and also FIG. 4C). The tape edge 53 provides a fixed edge about which the underside cover 47 may be biased and pivotable inwardly. In some applications, free edges or outer margins of the cover 47 may be elasticized and further flanged or structurally reinforced to ensure fit and assist in maintaining the border skirt 39 and top panel 27 in place.

In a preferred variation, the underside cover 47 is provided extended length to totally encompass the underside 33 of the core 23. The margins (which are free margins of the drape, initially, during assembly) of the cover 47 are brought together and mutually secured to fix the border 39 about the core sidewalls 41 and help ensure fit and stability of both the border skirt 39 and the top panel 27 about the core 23. Securement may be implemented with conventional manually detachable fasteners including clasps, buttons, Velcro (or hook and loop system) and zipper assembly.

Figure 2A:
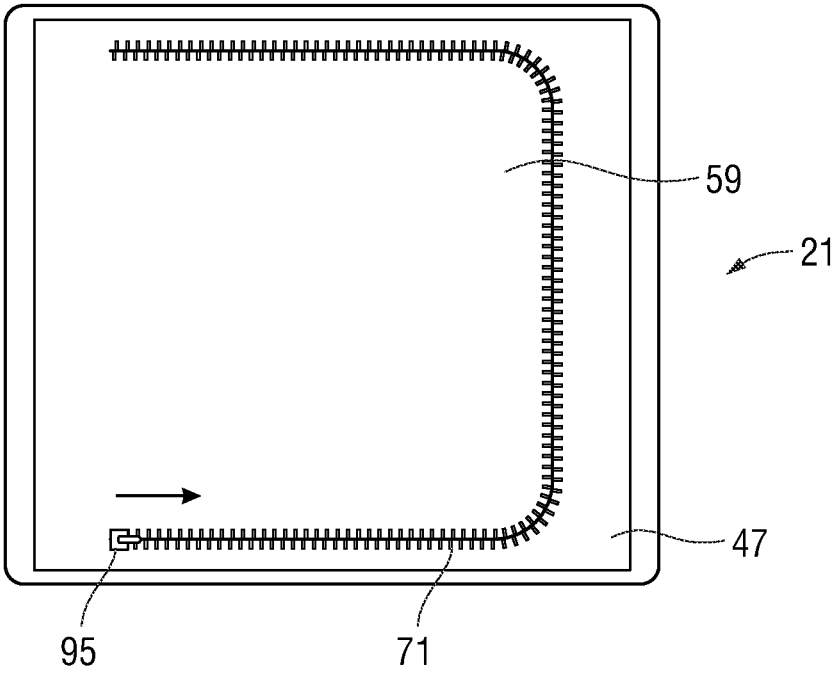
FIG. 2A is a bottom view of an alternate mattress according to the present description.

As shown in the exemplary design in FIGS. 1-3, the underside cover 47 is preferably provided as rectangular fabric having dimensions generally matching from those of the underside 33 of the core 23. When secured, the cover 47 is positioned, in the bottom view of the finished mattress assembly (see FIG. 2), inwardly of the perimeter edge 45 of the core 23 and preferably tightly fitted adjacent the underside 33. The cover 47 preferably includes a flap section or flap 59 detachably fastened via detachable fasteners such as hook and loop systems, VELCRO systems, buttons, hook and eye systems, zipper assembly, clasps, and the like. In the preferred design, a zipper assembly or zipper 71 is provided on the cover 47, which is operable to free the flap 59. Referring also to FIG. 7B, flap 59 may be zipped to complete and close the underside cover 47. Conversely, the detachable flap 59 may be disengaged from the cover 47 and peeled away to reveal a substantial opening 63. Beneath the opening 63, the cover assembly 25 defines an internal compartment 65. With the cover assembly 29 in FIGS. 1-3, the unzipped flap 59 may be peeled back to reveal core 23 received, in storage per se, in compartment 65. In other applications, the flap and zipper are located such that the drape opening is parallel with a wider side of the cover, and the dimensions of the flap and zipper runs are the same (e.g., defining a generally square shape or area). See e.g., alternate mattress design in FIG. 2A. Also, by providing a wider flap 59, less of the remaining sections of the cover need to be folded or "peeled" from or onto the top panel and core. Such a wider flap or flap located parallel to the wider side of the core and top panel facilitates initial assembly the cover assembly, assembly of the mattress assembly, and removal of the drape from the top panel or the core (e.g., inversion).

The detachable flap 59 is preferably elongated and extends inwardly from proximate the tape edge 53. The section 61 of the cover 47 outward of the zipper 71 and the flap 49 is a narrow width of fabric that extends sufficiently inboard of the core perimeter to facilitate assembly and fit, and to allow fastening with the extended flap 59. The zipper 71 is of conventional construction and typically includes a tape band and teeth (chain) on the flap 59 and on the fixed section 61. A manual tab 95 is provided for manually zipping (or unzipping) the underside cover 47 and enclosing and encasing the core 23 within the cover assembly 29, as shown in FIGS. 1-3.

In one aspect, the mattress assembly 21 provides for a readily removable (detachable) cover 47 or cover assembly 25 that also allow ready access to components of the mattress 21. The cover assembly 25 itself may be readily removed for cleaning or repair. The same applies for the core 23.

It should be noted that, as described above and independent of other components, the drape 29 is characterized by first and second margins each defining an opening and continuous sidewalls therebetween that define an inner space or volume. As shown herein, this interior space provides, at least partly, a compartment for receiving the core (or top panel).

As illustrated herein, the cover assembly according to the present description is a multi-component, multi-functional mattress unit. The cover assembly provides a storage facility—for the top panel prior to assembly and for the core after assembly. The cover assembly further provides and presents a cushioned sleeping surface and can contain multiple cushion and filler layers that may serve a variety of purposes (e.g., cover fabric, insulator, cushion, uniform surface and constitution and depth. The cover assembly also provides a platform for presenting decorative or aesthetically pleasing or neutral facings and dressings. The cover assembly is also configured so as to facilitate assembly of mattress, e.g., by virtue of elimination of components requiring manipulation or machination during assembly. The cover assembly also secures the top panel and border skirt with the core, imparts bias on the cover assembly components as desired, and facilitates and ensures fit and closure of components, as desired. In using the term "cover assembly", "top panel assembly" or "cushioned assembly", it should be clear, then, the choice of adjectives to qualify "assembly" is instructive and referential (to the present description) but should not be limiting. The term "cover assembly" is preferred herein, however, and correctly denotes, in a multi-component product incorporating textile materials, that the component provides at least partial coverage to another component.

With a cover assembly 29, such as that depicted in FIGS. 1-3, which has been presented as a unit at commencement of an assembly process according to the present disclosure, the unzipped 59 may be peeled back to reveal a top panel 27 disposed in the compartment 65. Furthermore, the compartment 65 (and opening 63) are closeable by fastening the zipper assembly 71 (i.e., fastening the flap 59 with the rest of or fixed section 61 of the underside cover 47).

FIGS. 4-12 are simplified illustrations representing steps or stages in a process for forming or assembling a mattress such as mattress 21 described above and depicted in FIGS. 1-3. In one respect, the assembly process starts with and requires only two starting components as shown in FIG. 4A—the top panel or cover assembly 25 and the supporting core 23 described above. These two functional units are integrated to form a complete, finished mattress unit 21 having a top panel 27 providing a pillowtop or cushion layers, a border or skirt 39, and a core 23 covered by the cover assembly 25. In FIGS. 4-12, the cover assembly 25 is provided as a unitary construction with a top panel or pillow top 27 containing all desired layers or fillers (e.g., cushion layers) and a border skirt 39 (with underside cover extension) fixed to the top panel 27 in a pre-assembly, stored position. The cover assembly 25 may also be described as having a top portion configured to present the sleeping surface and a bottom portion configured to incorporate the supporting core 23 therewith. To this end, the cover assembly 25 provides, as described and illustrated herein, a storage compartment 65 that, in a pre-assembly or shipping disposition is stowed (secured within the cover assembly 25) and closed. In an early stage of assembly, the compartment 65 in unlatched, opened, and placed in a disposition to engage, receive, and, at least partly, secure the core 23.

Figure 4A:
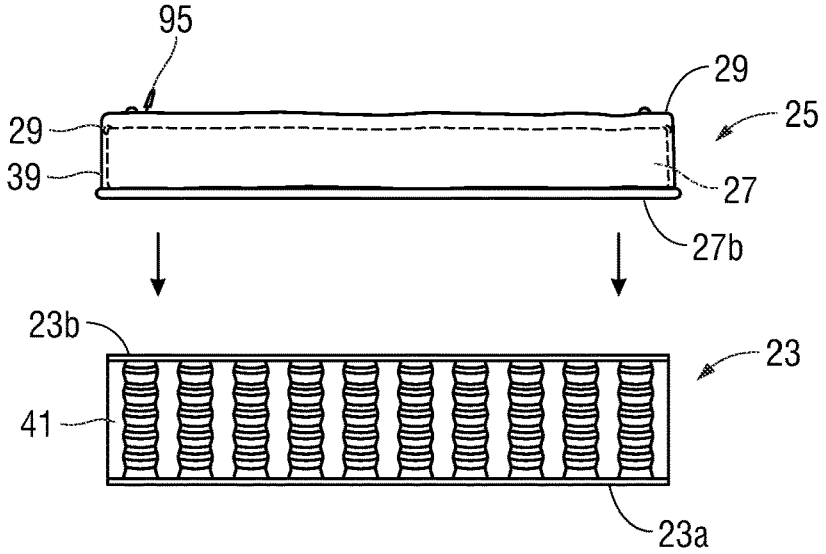
FIG. 4A is a simplified illustration in elevation view of a cover assembly and a supporting core which form the starting components of a method of forming or assembling a mattress assembly or mattress, according to the present description.
Figure 4B:
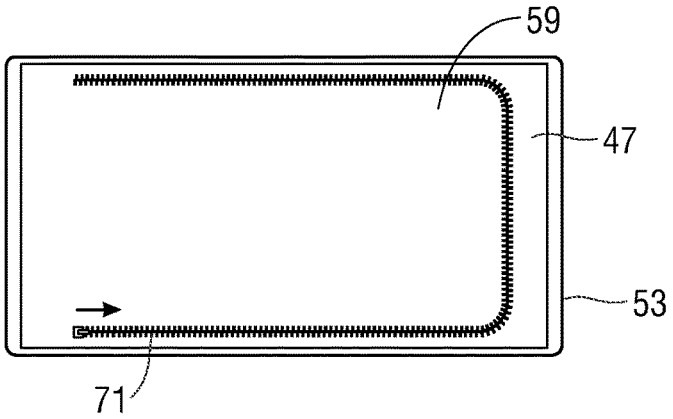
FIG. 4B is a simplified and exaggerated detail cross-sectional view of the cover assembly in FIG. 4A.
Figure 4C:
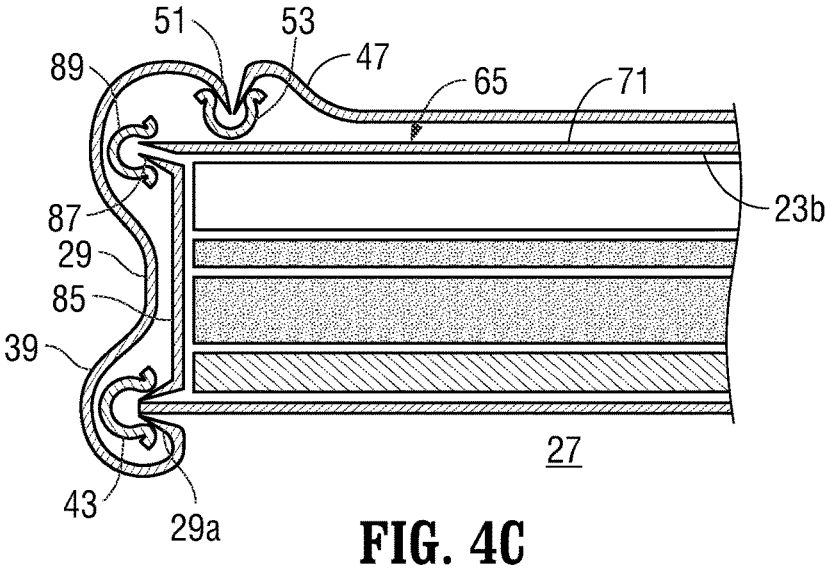
FIG. 4C is a simplified and exaggerated detail, sectional cut-away view of the top panel section in FIG. 3.

In a stored or pre-assembly position, as shown in FIG. 4A, the drape 29 is primarily held secured about and above the top panel 27. See also FIG. 4C. The drape 29 covers much of the top panel 27, including panel top 27*a* and vertical side walls 85 of the top panel 27. The underside cover 47 is disposed above the top panel 27 and self-secured by zipping extended flap 59 closed. Notably, much of the border skirt 39 is wrapped about sidewalls 85 (gusset 85) of the top panel 27, and extends toward panel top 27*a*. Typically, the side wall or gusset 85 of the top panel 27 is shorter, in height, than the core's side walls 41. Thus, in the stored or pre-assembly configuration of the cover assembly 25, border skirt 39 extends around tape edge 89 and above panel top 27*a*, as best shown in the detail of FIG. 4C. Furthermore, the drape 29 covers top panel 27 and, in one respect, provides a container or compartment 65 in which top panel 27 is received. Furthermore, the drape 29 is secured to and about top panel 27, in a stowed or circumscribed disposition (as opposed to its extended disposition described below).

The cover assembly 25 may be described as a core cover-top panel compact 25 (or simply compact 25), particularly in a pre-assembly configuration wherein the drape 29 and top panel 27 are mutually secured and disposed in a compact, mutually serving disposition. In one aspect of the present description, such a configured core cover and top panel compact 25 facilitates pre-assembly storage and shipping, especially with the drape 29 secured tightly about the top panel 27 simultaneously covering much of the top panel 27 and somewhat recessed therein. Further, the provision of a unitary, pre-assembly cover assembly or compact 25 allows for a complete top panel and border skirt (for the core) to be manufactured, shipped, and provided separately and independently of the supporting core (except that it must satisfy a set of dimension requirements identified to one of a limited number of standard mattress and core sizes).

Figure 5:
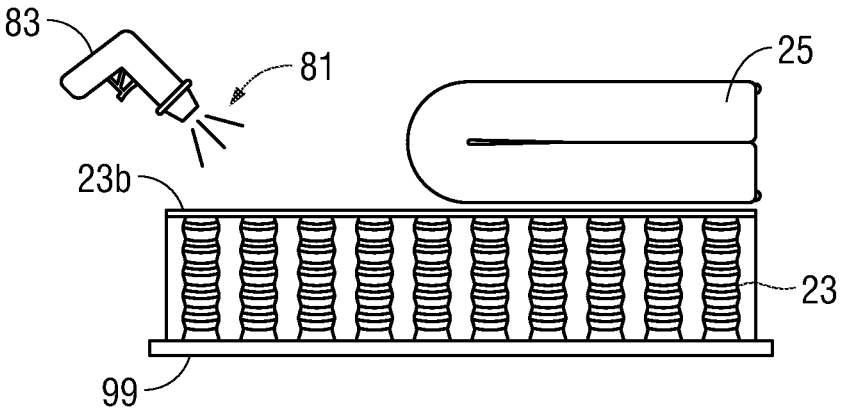
FIGS. 5 and 6 are elevation views illustrating steps during an alignment stage of the method of assembling the mattress.
Figure 6:
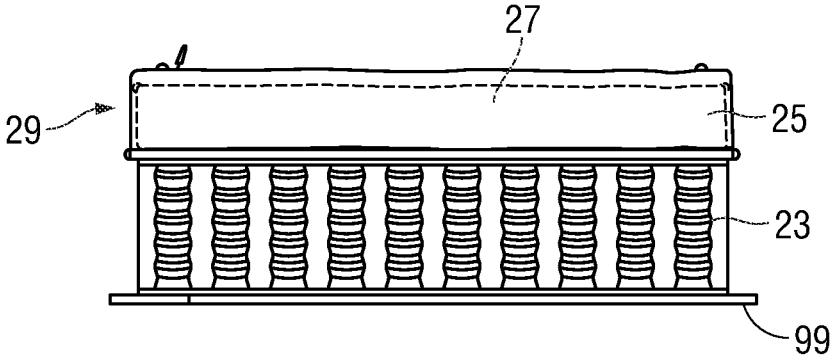

The configuration of the cover compact 25 also facilitates initial stages of assembly. As shown in FIG. 4A, the cover compact 25 and the core 23 are brought together, for alignment, to commence assembly, with the bottom side 27*b* of the compact 25 facing the topside 23*b* of the core 23. An insulating fabric (or other material surface) may be provided as a top planar surface 23*b* of the core 23. Now aligned with the core 23 supported on a table or flat working station 99, the mostly fabric and generally pliable compact 25 may be folded to facilitate access to the top surface 23*b*. This top surface 23*b* is then preferably applied with an adhesive 81 (via adhesive applicator 83), as shown in FIG. 5, to ease alignment and assembly. The compact 25 is then unfolded and set on the surface 23*a* (with adhesive 81 applied thereon), adhering the cover compact 25 (specifically the top panel 27) in mutual alignment with the core 23. See e.g. FIG. 6.

Figure 8:
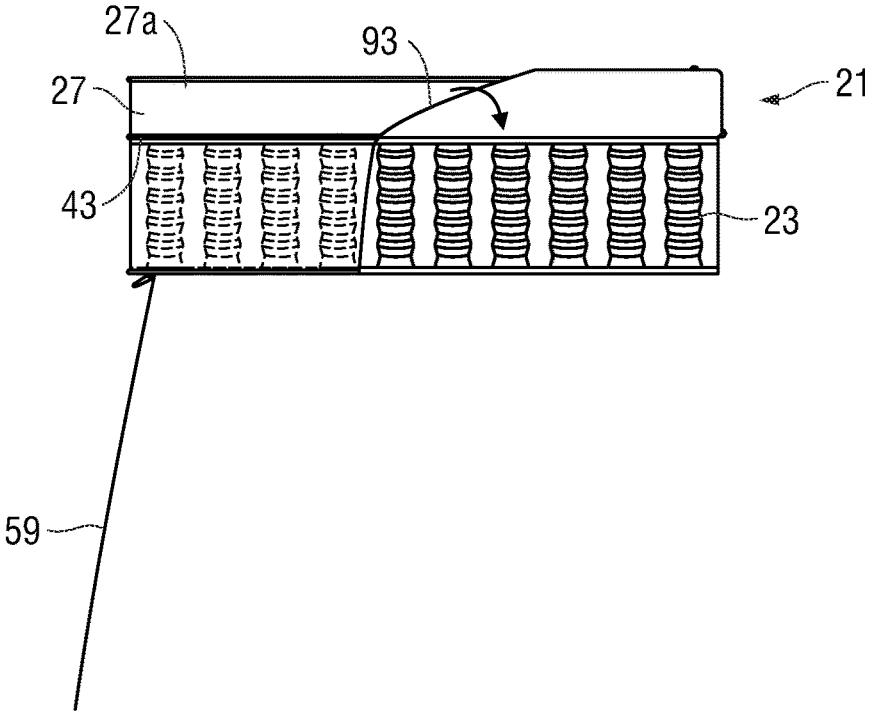
FIG. 8 is an elevation view illustrating continuing steps in deploying the drape and receiving the core, in the method of assembling the mattress.
Figure 9:
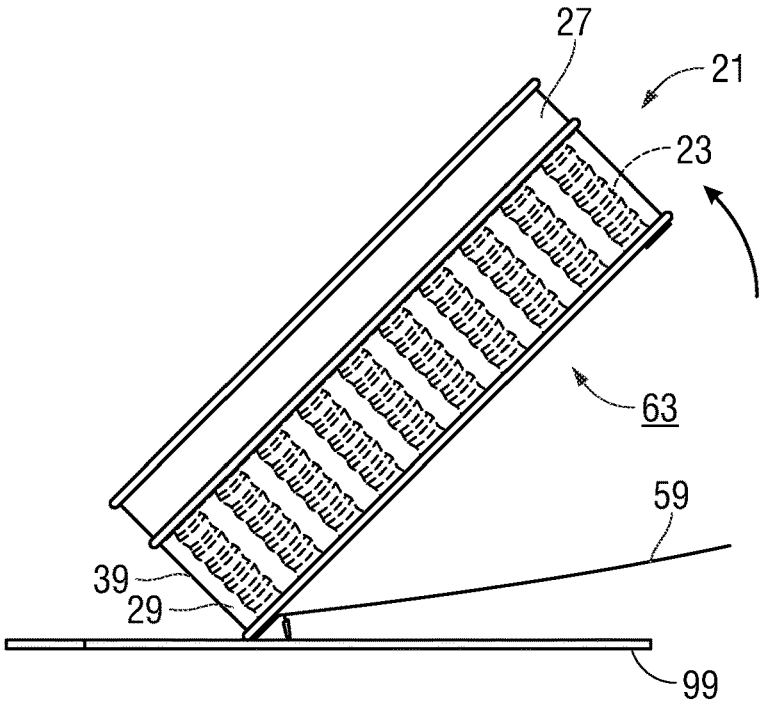
FIG. 9 and are elevation views illustrating continuing steps in securing the cover assembly and core, in the method of assembling the mattress.
Figure 10:
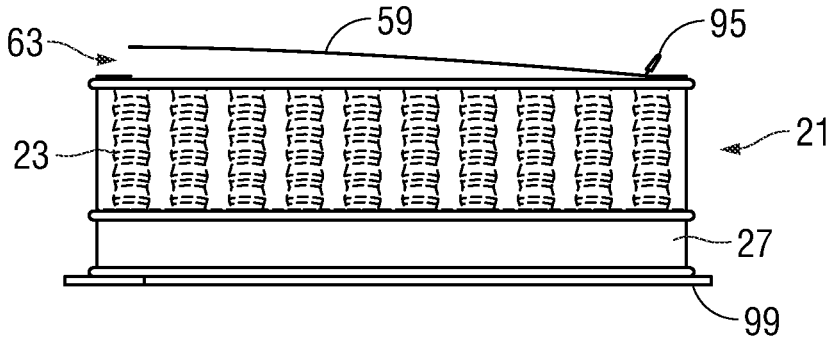
FIG. 10 is an elevation view of the mattress assembly in an upside-down position, in the method of assembling the mattress.
Figure 11:
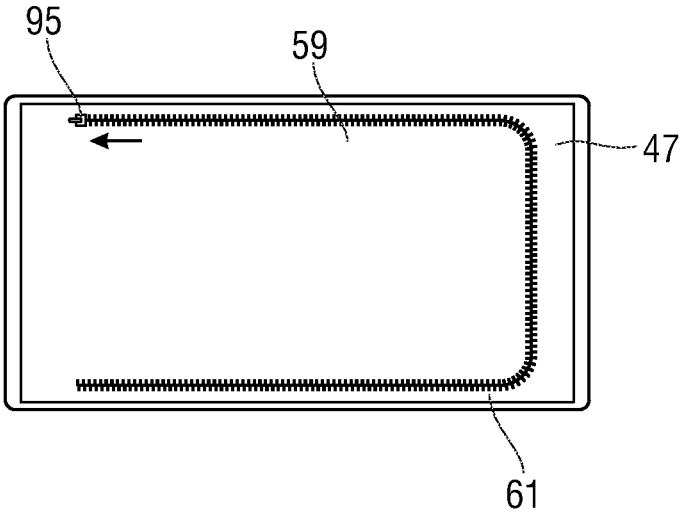
FIG. 11 is a top view of the mattress assembly after securing the drape, in the method of assembling the mattress.
Figure 13:
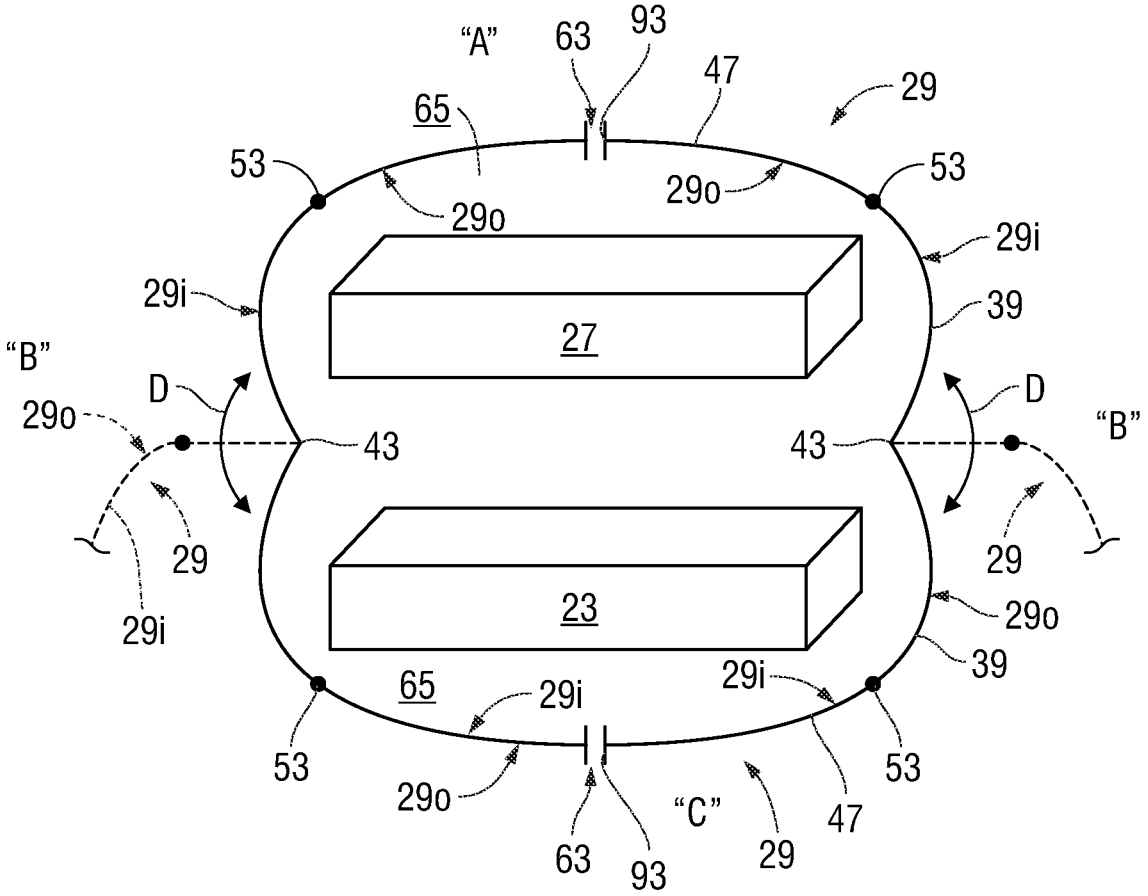
FIG. 13 is a simplified diagram illustrating techniques in deploying or disengaging a drape of a cover assembly on or from a core, in a mattress assembly according to the present description.

At this stage, the underside cover 47 is actually presented on top, providing ready access to zipper 71 and flap 59. FIGS. 7-9 now illustrate deployment of the drape 29 to integrate the core 23 with the cover assembly, while FIGS. 9-10 show securement of the underside cover 47 about the core 23 to complete the deployment. The diagram of FIG. 13 is also provided to illustrate, among other things, how efficiently the drape 29 is deployed and the core 23 IS integrated (with the cover assembly 25) in accordance with assembly methods of the present description.

Figure 7A:
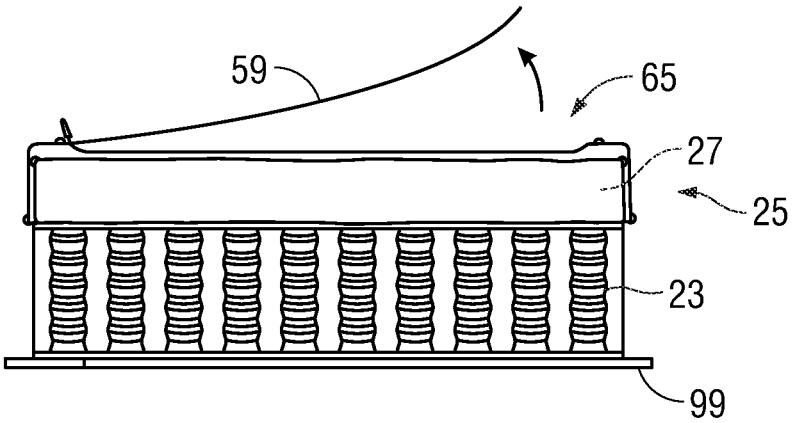
FIGS. 7A and 7B are elevation and top views, respectively, illustrating initial steps in disengaging or deploying a drape of the cover assembly, in the method of assembling the mattress.
Figure 7B:
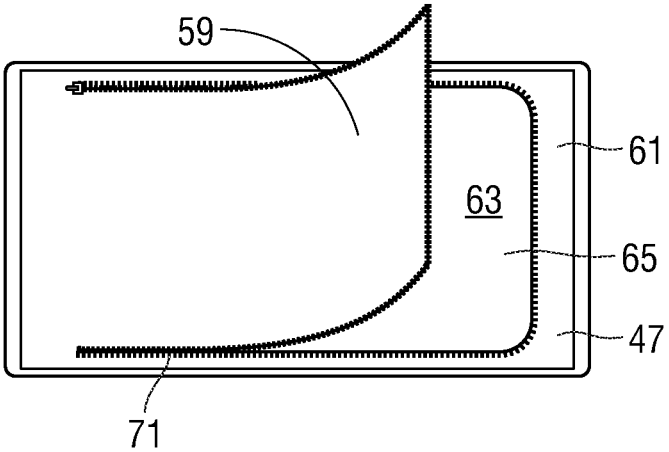

Referring now to FIGS. 7A and 7B, the flap 59 is detached from underside cover 47 by operating zipper 71, and pulled away from the fixed sections 61 of the cover 47. With the cover 47 opened and exposing compartment 65 thereunder, sections 61 of the underside cover 47 remain fitted over top panel 27, but loosened. This allows narrow sections 61 of the underside cover and border 47 to readily pulled away peeled back from top panel 27. In fact, the loosened drape 30 may be pulled entirely away and downwardly from the sidewall 85 of the top panel 27, as illustrated in FIG. 8. As the drape 25 is pulled away from the top panel 27, the border skirt 39 follows (or is also pulled away) and is rotated away from the top panel 27 and onto the sidewalls 41 of the core 23. As illustrated also in FIG. 13, the drape 29 is essentially inverted by pulling the free margins (or second margins) or un-detached sections 61 of the compact 25 and pivoting about top panel 27. The border skirt 39 is turned through a tight 180 degrees rotation from the sidewalls 85 of the top panel 27 but readily inverts and transfers onto the core sidewalls 41.

Now rotated 180 degrees from its original position and inverted, the deployed border skirt 39 fits tightly about the sidewall 41 of the core 23. Free margins 93 of the drape 29, including underside cover 47, are extended beyond the bottom perimeter 45 of the core 23. In this way, and with the margin sections properly tucked beneath the core 23, the core 23 is received by the drape 29 in a defined compartment 65. At this point, the flap 59 may hang freely from the rest of the mattress assembly 21 as shown in FIGS. 8 and 9, and thus, compartment 65 remains open. Comparing the initial disposition of the cover assembly 25 in FIG. 6 with its disposition in the finished mattress assembly 21 in FIG. 1, the cover assembly 25 and drape 29 has been inverted—in respect to the disposition of its respective surfaces (outer facing—inside facing) as well vertical disposition relative to the top panel 27 (extending downwardly or upwardly). In this respect, the cover assembly 25 and drape 29 are referred to as being invertible, as well as being extendible relative to the top panel 27 (i.e., to integrate and receive the core 23).

For convenience, the nearly-complete mattress assembly 21 is then flipped over, so as to expose and provide access to the underside cover 27 and the opening 63. See FIGS. 9-10. Here, the free margins 61 of the underside cover 47 may be pulled more tightly over and inwardly beyond the perimeter of the core 23. This also ensures a snug fit of the border skirt 39 about the core sidewalls 41. The extended flap 59 is then fastened using the zipper 71 to close opening 63 and compartment 63 and uniting flap 59 with the rest of the underside cover 47. See FIG. 11. At this stage, the core 23 is received in compartment 65 and secured with the cover assembly 25.

Figure 12:
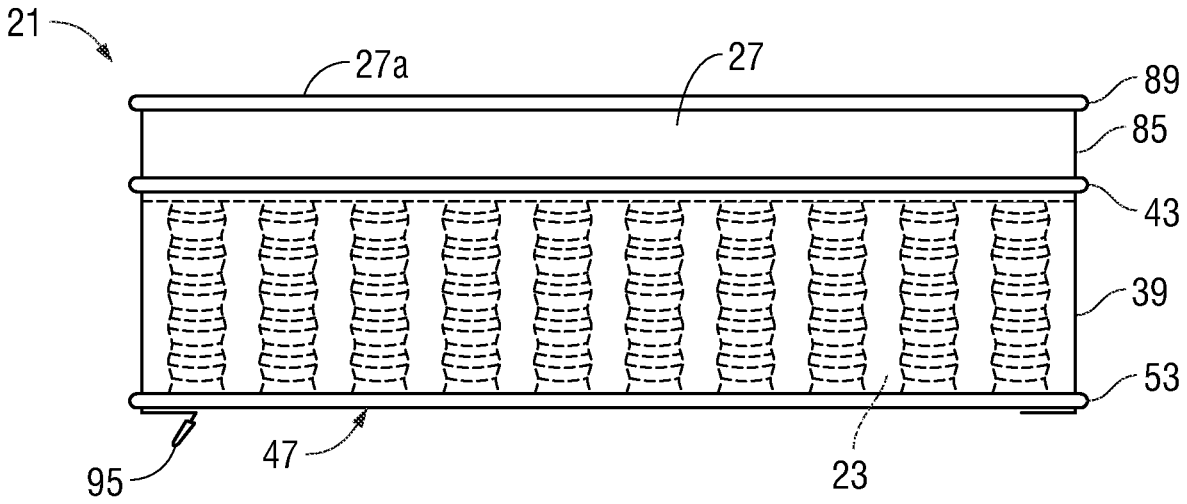
FIG. 12 is an elevation view of the mattress assembly in a final disposition, in the method of assembling the mattress.

FIG. 12 depicts the integrated mattress assembly 21 subsequently flipped over to its upright, normal position. The mattress assembly 21 is described, for purposes of the present description, a complete and finished mattress, which includes the supporting core 23 encompassed by, and in this design, completely encased by a cover assembly 25, in accordance with one aspect of the present description. In one aspect of the present description, as described above, the top panel assembly incorporates at least a border skirt extending from the top panel or pillow top section and, optionally, further means for fastening to the supporting core. In another aspect, the top panel assembly includes a drape having free margins that are detachably engageable to secure the top panel assembly prior to assembly (e.g. by using zipper 71 to unite the cover 47 portion into a whole cover) and deployable therefrom to integrate or encase the core to complete the mattress assembly.

Referring again to FIGS. 1-3, an exemplary fitted cover assembly 25 may be described a consisting of a cushioned subassembly or top panel 27 and a drape 29 extendible and deployable therefrom to capture or receive the supporting core 23. In further designs contemplated by the present description, the drape may be an independent piece readily attachable to the top panel during an initial stage of assembly or an exaggerated, movable extension of a portion or component of the top panel (e.g. sidewall cover fabric). As a key feature, the drape 29 is detachably engageable or fastenable to/with the top panel 27 in a somewhat recessed fashion that is conducive to storage and shipping, and to initial alignment with the core. The drape 29 is also fixed with but movable relative to the top panel 29 (i.e., fixably movable), which means one point or portion remains affixed during assembly. The drape 29 in the cover assembly 25 of FIGS. 1-13 is, in particular, fixed to the top panel 29 at all times but the remaining length or extension of the drape 29 is extendible or deployable from the top panel 27 (as shown) and pivotable about the attachment point or edge 43. In cover assembly 25, this fixed edge 43 is provided by tape edge 43, which clamps and affixes a fixed end or margin (first margin) of drape 29 to the top panel 27. Other fastening means such as a stitched seam, hook and loop, staples, and the like may be used in alternative designs.

Aspects of the present design and present description are generally applicable to various known top panel configurations. A typical assembly for a top panel includes an outer fabric and bottom fabric serving, among other things, as a containment cover for a multiple quilting panels and filler layers, including foam, memory foam, latex, and/or micro-pocket coil, and/or fabric layers (sometimes referred collectively, herein as "fillers' when discussing material layers within the top panel). The bottom cover material may be a non-woven and/or also provide an insulating layer. A similar fabric may be use for the gusset and applied vertically between the cover layers and all around the top panel to cover the edges of the contained layers and present a more aesthetically desirable outer appearance. In one aspect of the present description, a tape edge is provided as an all-around bottom edge and all-around top edge of the top panel, as shown in the FIGURES. The tape edge may be applied at the bottom edge to join or close the ends or margins of the drape (por border portion), the top panel's sidewall cover fabric, and the bottom cover fabric. Similarly, a tape edge may be applied at the top edge to join or close the ends or margins of the top cover fabric and the sidewall cover fabric. In a further aspect, a tape edge is used to join the ends or margins of the border/skirt and the underside cover.

Although other fastening or closing means may be used to join various parts or sections of the fitted cushion assembly, as described above, the inclusion of tape edges offers additional benefits to the overall mattress design. Tape edges are generally regarded as a desirable aesthetic feature of the finished mattress, projecting a neat, layered, and sophisticated look to the design. In the present design, the all-around uniformity and robustness of tape edges also facilitate handling during mattress assembly and contributes to the snug fit of the cushioned assembly with the core. Further, the tape edges are particularly well suited to serve as joints and pivot points for the various parts or sections of the fitted cover assembly and top panel, which are advantageous during assembly and for maintaining fit.

Tape edges are known devices to close the edges of mattress layers. Tape edges may be applied manually or by use of a variety of tape machines, as generally known in the art. Tape edge machines may also be used implement a tape or band material to close the edges, as shown in FIGS. 1-12. Other edge-closing techniques eliminate the use of a band or tape. The use of these and other techniques, and various tape edge designs, are suited for use with the presently described designs, in accordance with the present description. U.S. Pat. Nos. 7,647,876, 6,995,043 and 5,432,964 provide descriptions of conventional or prior known methods of forming a mattress, and particularly, employing a tape edge or binding tape. These descriptions are hereby incorporated by reference, in their entirety, for purposes of providing background and general knowledge in the art that may be applicable to implementing certain features or techniques taught or used in the present description (including, but not limited to the use of tape edges and alternate fastening devices).

It should be noted, however, that the presently described designs and techniques offer, as one aspect, the inclusion of pre-implemented tape edges in the top panel assembly and for integration with the core to provide a mattress with one or more outwardly presenting tape edges. In a conventional method of manufacturing a mattress, tape edges are usually applied, in a late stage operation, to join or close the various layers or edges of the mattress (with the top panel and core already joined). Notably, typical machine-assisted application of tape edges on mattresses can be a laborious technique requiring expensive, specialized tape edge machines and skilled operators. Thus, the provision of a fitted cushion assembly with pre-installed edges that present, when the fitted cushion assembly is integrated with a core to make a finished mattress, offer unique manufacturing advantages. Firstly, the step of finishing the mattress assembly, or fitting and dressing the core and integrating a complete top panel and border, is greatly simplified and made more efficient and less costly. Secondly, the basic construction of the fitted cushion assembly allows flexibility in the division and selection of labor and sourcing aspects of the manufacturing process, in a way that can enhance quality and reduce cost. For example, the fitted cushion assembly may be manufactured remote and/or separate from the core or form the final assembly location, thereby taking advantage of access to materials and workforce. Also, the final mattress assembly (as described above) is much simplified, and requires little manpower, specialized machines, and additional materials or components. The final assembly may be located, therefore, at or closer to retail locations. It is particularly noted that the provision of a fitted cushion assembly as one of two (or more) components for assembling a complete mattress at or near end destination location allows the manufacturer or end user to take advantage of the benefits of manufacturing or assembling parts of the mattress at preferred manufacturing locations (e.g., lower material and labor cost, and the like, access to skilled artisans, etc.) without increasing cost and complexity of manufacture (e.g. due to a multi-part manufacturing process). In some situations, for example, as in the case of outsourcing mattress manufacturing outside of the United States, government or trade-related costs and levies may be reduced by shipping mattress parts to the United States as opposed to complete, finished mattresses.

The cover assembly 25 according to the present description is configurable in at least two dispositions—a first (stored or pre-assembly) disposition wherein the drape 29 is secured about the top panel and a second disposition wherein the drape is deployed and secured about the core 23, thereby integrating the core 23 with the top panel 27 (and cover assembly 25) in a finished mattress assembly 21. The diagram of FIG. 13 describes the deployment of the drape 29, relative to the top panel 27 and the core 23, from a starting configuration disposed about the top panel 27 (at top, denoted by "A"), in an open, intermediate (transitory) disposition (denoted by "B"), and finally, in a configuration disposed about the core 23 (at bottom, denoted by "C"). The directional arrows, D, in the diagram represent the rotation of the drape 29 from about the top panel 25 to about the core 23, while pivoting about fixed edge 43 (tape edge 43). The directional arrows, D, are bi-directional signifying that the drape 29 may be deployed back and forth between the two dispositions and associated configurations ("A", "C"). The underside cover 47 may also be described as pivotable about edge 53 (tape edge 53), although edge 53 is in itself movable relative to the fixed edge 53. Noting that the drape 29 is of a flexible material with all-around walls, the drape 29 is closeable at free margins 93 to enclose the cover assembly 25 about the top panel 27 or the core 23. FIG. 13 also illustrates that to achieve the configuration or disposition in "C", the drape 29 is basically inverted from its initial disposition or configuration (in "A"). Notably, in FIG. 13, drape surface 290 and **29*i* change from interior (facing) and exterior (facing) surfaces to opposite-facing surfaces as drape 29 is pivoted away from top panel 27**.

The discussion of certain aspects of the mattress assembly 21 and method according to the present description, as provided immediately above, may also be served by examination of the "before" and "after" illustrations of the cover assembly 25 or compact 25 provided by FIGS. 3-3A and 4A-4C. Along with the diagram of FIG. 13, the details of FIGS. 3A and 4C also illustrate the movement and disposition of the drape 29 relative to the top panel 27 and core 23—prior to assembly and during (after) assembly. In the pre-assembly or storage configuration of the compact 25 in FIG. 4C, the drape 29 is secured about the top panel 27, with the backside surface of the drape 29 (the surface that is not intended to be facing outward in the finished mattress assembly 21) presented outward and also covering and protecting the finished surfaces of the gusset 85 and panel top 27*a*, including the tape edges 43, 89 of the top panel 27. With the drape 29 fairly slacked relative to the top panel 27, the bottom border skirt 39 and tape edge 53 may rest on or fall inwardly and away from the perimeter during storage and shipping. The drape 29 may otherwise be characterized as elongated and geometrically contrasting the top panel 27, but, in one aspect, drape 29 is "recessed" within the top panel 27, thereby making for a compact cover-top panel compact. That is the otherwise hollowed drape 29 enwraps the sidewalls 85 of top panel 27 instead of extending or protruding therefore and much of the underside cover 47 is turned into and onto the top panel 27. Also, both the drape 29 and the panel 27 are primarily layered and pliable and thus, the drape 29 and the panel layers readily collapse upon each other. Atop the panel top 23 *a*, the relative stiff tape edge 53 helps support the unfolding drape 29 and the height difference (between the core side walls 85 and the skirt 39) allows and urges the underside cover 47 to "fall" into and rest on the top panel. Notably, tape edge 53 is (facing) on the inside of the drape 29 in this stored or recessed (disposition of drape 29 relative the top panel 27 versus extended therefrom). Further, when drape 29 is detachably fastened and extended about (as opposed to being extended from or away) the top panel 27, the drape 29 covers (and protects) tape edges 43, 89, and 53.

When the cover 47 is opened and detached (by operating zipper 71), the drape 29 may be pivoted about its fixed margin 29*a* and tape edge 43. See again FIG. 13 and also FIG. 3A. When deployed about core 23, drape 29 reveals tape edges 43, 87, as well as tape edge 53. Tape edge 53 is also moved away and flipped (inverted with the drape 29) and is facing or presented outwardly with border skirt 39 enwrapping the core sidewalls 41. And, as further shown in FIG. 3A, the inverted drape 29 also reveals and presents the finished surfaces of the border skirt 39, gusset 85, and panel top 27*a*. Moreover, when disposed about the core 23, the inverted drape 29 may be tucked and fitted more tightly about the top panel 27 and core 23 to present a complete, finished mattress assembly 21.

In alternate constructions or designs, additional fillers or layers may be included. Also, the top panel may be provided with openings or fasteners for accessing the inside of the top panel or providing an opening through which different or additional layers or fillers may be inserted. The inserts may be added at the mattress assembly location, during mattress assembly or immediately thereabout.

In alternate constructions or designs, the drape and/or the border skirt and/or underside cover may be fastened during mattress assembly. These same items may also be provided as detachably fastened items, using, for examples, zippers, buttons, hook and loop, and similar means, in addition to or in lieu of the tape edge connections. For example, the drape may be attached via detachable fastening means about a bottom perimeter of the top panel as an initial step in the assembly process. Then, the free margins of the drape is extended over or deployed onto the core and the core underside, before closing the free margins using the same fastening devices described herein.

In alternate constructions or designs, the border skirt or margin extension thereof may be attached to the core to help secure the border skirt and top panel. Alternatively, a separate underside cover material may be provided but provide less than complete coverage of the underside of the core. The margins of the underside cover may not be re-fastened to matching sections of the underside cover but to the sidewall or underside of the core. Securement may be achieved through use of all-around elasticized edges or margins, hook and loop systems or Velcro, buttons, clips, clamps, and the like, or combination thereof.

In alternate constructions or designs, drape may be provided with the core and is configured to be removably fastened to/with a top panel or pillowtop assembly. The drape may include an extendible fabric that can be opened, disengaged from the core and unraveled in two or more drape sections. The drape section may be pivoted and extended, from the underside of the core, with a top edge (e.g., tape edge) or margin about the top perimeter of the core, and brought about and atop the top panel, where the drape is fastened back together and closed to receive the top panel in a defined compartment. In this way, the re-fastened drape provides a fabric sidewall and top cover of the top panel, while integrating (securing) the top panel and core-border skirt to complete the finished mattress. Such a design variation may be achieved borrowing most of the structural aspects already described herein, except that the fixed edge about which the drape is pivoted (a tape edge) is provided about a top perimeter of the core. From an initial configuration affixed to the core, the drape is deployed by opening and then inverting the drape's margins and walls.

Figure 14A:
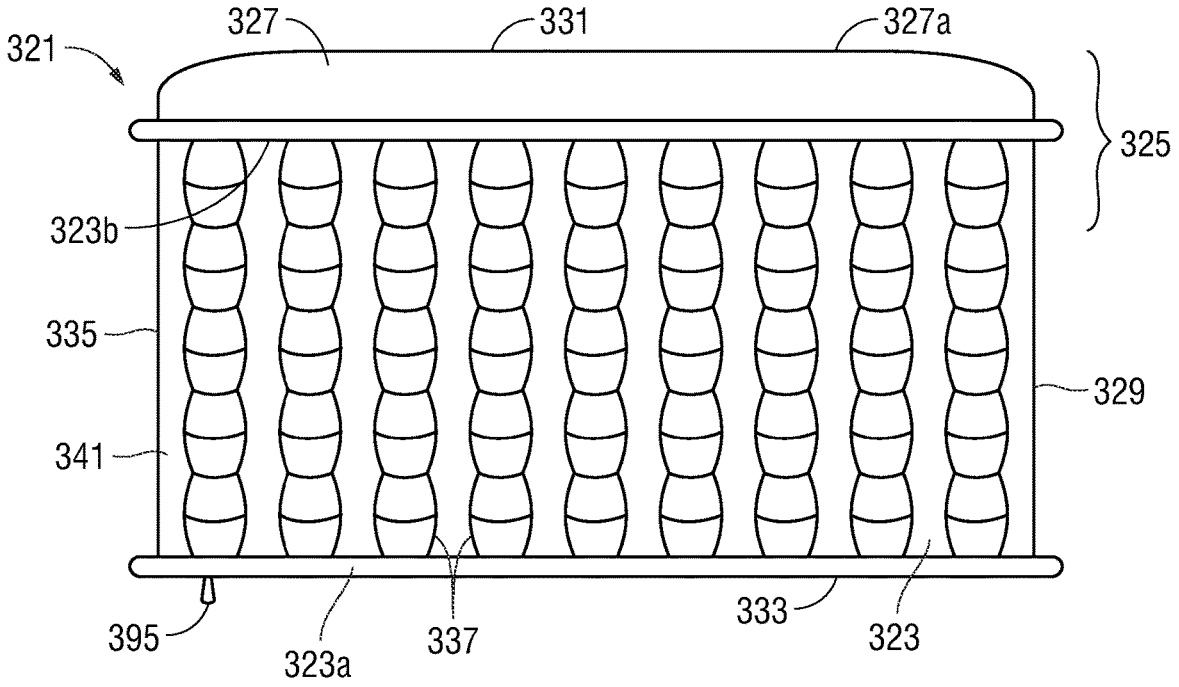
FIG. 14A is a simplified illustration in elevation view of an alternate complete, finished mattress according to the present description, with a bottom portion shown in partial cross-sectional cut-out view to reveal an interior.
Figure 14B:
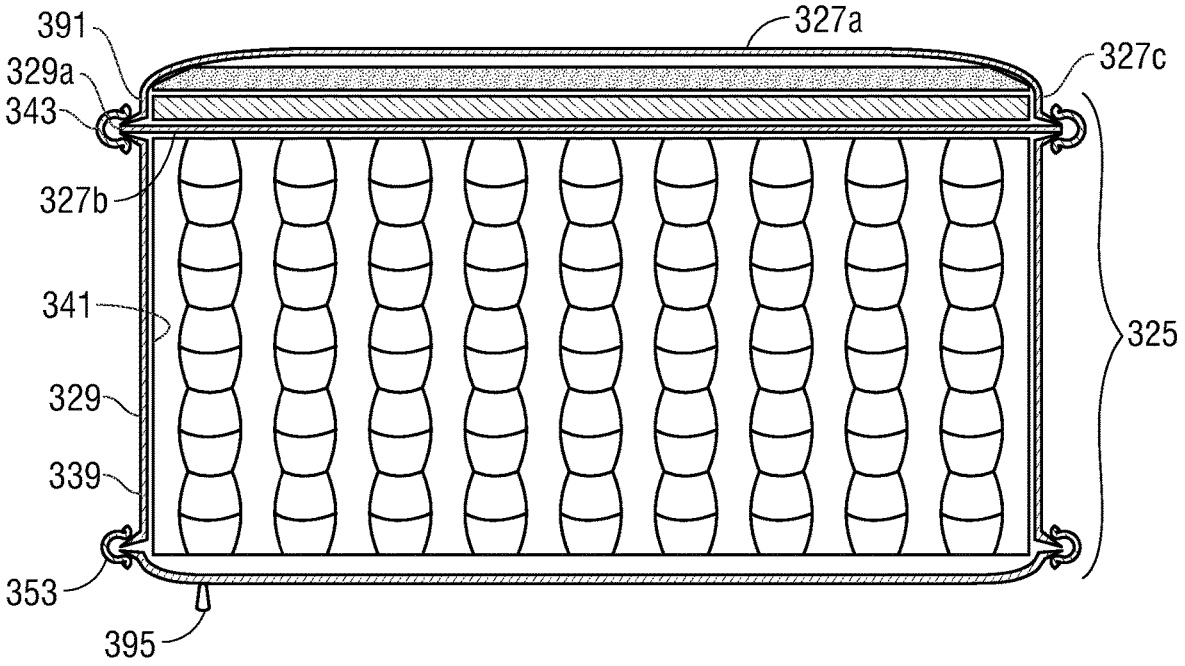
FIG. 14B is a further cross-sectional view of the mattress in FIG. 14A with remaining portions shown in cross-sectional view.

The simplified illustrations of FIGS. 14A and 14B show a further embodiment or variation of the mattress assembly 321 according to the present description and highlighting an alternate construction, design and/or features. These two FIGURES correspond with FIGS. 1 and 3, respectively, and thus, employ similar/like reference numerals (in 300s series rather than in the 10s series) to enumerate like elements. In FIG. 14A, a bottom portion of the mattress assembly 321 is shown in partial cross-sectional cut-out view to reveal an interior (which employs an alternate foam construction). FIG. 14B is a further cross-sectional view of the same mattress assembly 321 with the remaining portions shown in cross-sectional view to highlight the connections and engagement between the core and the drape. As shown, the mattress assembly 321 includes a similar, but modified, cover assembly 325 and core 323 encased or engageable or encaseable/enclosable by the cover assembly 325. The cover assembly 325 further includes a pillowtop or panel assembly 327 and a drape 329 (similar to the ones described in respect to FIGS. 1-13).

Notably, the alternate construction of FIGS. 14A and 14B features a single top, tape edge 343 affixing the drape 329 (at perimeter edge 329*a*) near or about the (bottom) perimeter of the top panel 327 to a bottom perimeter of a top panel fabric 391, and a bottom tape edge 353 closing a bottom perimeter of the mattress assembly 321. In this design, there is no top perimeter edge of the top panel 327 to affix or attach, and thus, no top edge as in previously described embodiments. Instead, the cover fabric 319 extends (smoothly) from the top side 327*a* of the panel and downward to the drape 329 and edge 329*a*, with or without an interface (as shown) or seam at the top perimeter edge of the top panel 327. The cover assembly 325 (and drape 329) operates in the same manner as the cover assembly 325 previously described (FIGS. 1-13) to integrate, attach, and otherwise engage the core 323 during storage, transport, assembly, and use. It is noted, however, that upon disengagement of the drape 329 from a stowage position above the top panel 329 and re-engagement about the core 323 (e.g., inverting the drape 329), a complete and finished top panel 325 is revealed (as shown in FIGS. 14A and 14B).

The following is a non-exclusive listing of various, exemplary applications, variations, and/or embodiments contemplated by described concepts. The enumerated concepts include methods, products, assemblies, articles of manufacture and the like, that are characterized by the below listing of features. This list should not be considered limiting, however, as, for example, the elements or features listed below, in respect to a product, assembly, or structure, may be combined with each of the other elements associated with other product, assemblies, and structures. The same applies to methods and various, exemplary steps listed below. Also, the Specification, including the Summary, the Drawings, and the claims, describe or depict other applications, variations, embodiments, and combinations of elements which may not be included below, but are contemplated as encompassed by the described concepts.

1. A mattress assembly comprising:
   a support core; and
   a cover subassembly including a plurality of filler layers secured within a cushioned panel and a drape extending from the panel;
   wherein the drape includes a skirt secured about sidewalls of the core.

2. The mattress assembly of example 1, wherein the drape further includes a cover extension extending outward of the skirt, relative to the cushioned panel, to at, least partially, cover an underside of the mattress and securing, at least partly, the drape.

3. The mattress assembly of example 2, wherein the cover extension is secured beneath the core.

4. The mattress assembly of example 2, wherein the cover extension covers the entirety of the underside.

5. The mattress assembly of any one of examples 1, 2, 3, or 4, wherein the cover extension is secured beneath the mattress to encase the mattress within the cover subassembly.

6. The mattress assembly of example 5, wherein the cover extension is zippered.

7. The mattress assembly of any one of examples 2-7, wherein the cover extension includes a drape margin extended beyond the sidewalls of the core and fitted adjacent the underside of the core.

8. The mattress assembly of example 8, wherein the cover extension includes an extended flap secured, beneath the underside of the core, to sections of the drape margins to secure the cover extension beneath the core underside and encase the core.

9. The mattress assembly of example 8, wherein the cover extension is detachably fastenable.

10. The mattress assembly of any one of examples 1-9, wherein the drape is joined to the cushioned panel by a tape edge.

11. The mattress assembly of any one of examples 1-10, wherein drape further includes a tape edge defining a margin interface of the border and an underside cover extension commonly joined with the border.

12. The mattress assembly of any one of examples 1-11, wherein the cushioned panel includes a tape edge closed about edges of one or more layers of the cushioned panel.

13. The mattress assembly of example 12, wherein the cushion panel includes at least two tape edges, including a tape edge positioned adjacent a bottom perimeter of the cushioned panel and a tape edge positioned adjacent a top perimeter of the cushioned panel.

14. The mattress assembly of any one of examples 1-13, wherein the drape is invertible between a first disposition wherein the drape receives the core and a second disposition wherein the drape is extended about the cushioned panel.

15. The mattress assembly of any one of examples 1-14, wherein the drape is pivotable about an edge adjacent said cushioned panel to extend about the cushioned panel and pivotable about the edge to extend about the core.

16. A method of forming a mattress comprising the steps of:

providing a cover assembly including a top panel having one or more filler layers and a drape fixed to the cover assembly;

juxtaposing the cover assembly with a supporting core having a topside, an underside, and sidewalls therebetween; and extending the drape to integrate the core with the cover assembly to form a mattress.

17. The method of example 16, wherein said extending includes fastening the drape to the core.

18. The method of example 16, wherein said drape includes a border skirt and said extending includes engaging the core with the drape such that the border skirt wraps about the sidewalls of the core.

19. The method of any one of examples 16-18, wherein said extending includes encasing the core with the drape.

20 The method of example 19, wherein said encasing includes uniting free sections of the drape to encase the core.

21. The method of example 20, wherein said uniting includes zipping the free sections together.

22. The method of example 20, wherein said uniting includes fastening the free sections together to cover the underside of the core.

23. The method of any one of examples 16-21, wherein the extending includes detaching free sections of the drape and extending the free sections proximately about the core.

24. The method of example 23, wherein said drape has a fixed margin affixed to the top panel and fabric extending therefrom and the extended fabric incudes free margins detachably fastened to the top panel, said extending including detaching the free margins from the top panel.

25. The method of example 24, said extending including attaching, after said detaching, the free margins to the core.

26. The method of example 24, said extending including re-attaching, after said detaching, the free margins beneath the core.

27. The method of example 26, wherein, with said re-attaching, said cover assembly encases the core.

28. The method of any one of examples 16-27, wherein the drape is attached to said top panel at a tape edge, said extending including pivoting the drape about the tape edge to engage the core.

29. The method of example 28, wherein the tape edge is located about a bottom perimeter of the top panel and said pivoting reveals at least one other tape edge disposed about the top panel.

30. The method of example 28, wherein the drape includes a border skit for fitting about the side walls of the core and a cover extending outward from the border skit at a tape edge, said extending further including pivoting said cover at the top edge to extend over the underside the core and urge the border skirt about the sidewalls.

31. A mattress assembly comprising:

a support core mattress component including a core having a topside, underside, and all-around side construction therebetween; and a cushion assembly mattress component including a plurality of filler layers secured within a layered cushion panel;

wherein a first of the mattress components further includes a drape having a fixed margin secured to that first component, and a free margin secured to the second of the mattress components.

32. The mattress assembly of example 31, wherein the drape is attached to the first component at a tape edge and extended over the second component.

33. The mattress assembly of example 32, wherein the drape is extended over the second component to encase the second component.

34. The mattress assembly of example 31, wherein the first component is a support core having a border skirt about said all-around side construction, the drape including a cover fabric extending from the border skirt and about the top panel.

35. The mattress assembly of example 31, wherein the first component is a cushion assembly including a top panel containing filler layers and at least two tape edges closing edges of the layers about a perimeter of the top panel, the drape extending from the top panel and about the sidewalls of the core to engage a border skirt thereabout.

36 The mattress assembly of example 35, wherein the drape further includes a cover extending from the border skirt and enclosing the underside of the core.

37. The mattress of example 36, wherein the cover includes detachably fastenable free margins that are united beneath the core to encase the core with the cushion assembly.

38. The mattress assembly of example 37, wherein the cover includes a fastener selected from the group consisting of: hook and loop, velcro systems, buttons, clasps, zipper, and combinations thereof; and wherein said free sections are fastened together with said fastener.

39. The mattress assembly of example 31, wherein the first component is a support core having a border skirt extending between the top side and the underside, the core further including a top tape edge defining an upper margin of the border skirt and a bottom tape edge defining a lower margin of the border skirt; and wherein the drape is joined with the border skirt at the top tape edge and extends therefrom toward the cushion assembly.

40. The mattress assembly of example 39, wherein the drape further incudes a cover extension interfaced with border skirt at tape edge and extending beneath the core to enclose the core.

41. A mattress top panel subassembly for engagement with a support core to complete a mattress assembly, the top panel subassembly comprising:

a top panel containing a plurality of filler layers, the top panel having a topside, an underside, and an all-around cover facing extending between a perimeter of the topside and a perimeter of the underside; and and a drape extending from the top panel proximate the perimeter of the top panel underside toward the topside and detachably fastened thereabout.

42. The mattress assembly of example 41, wherein the drape includes a cover extension extending inwardly of the top perimeter and over the topside.

43. The mattress assembly of example 42, wherein the cover extension includes free margins that are detachably united above the top panel.

44. The mattress assembly of example 42, wherein the cover extension covers the topside.

45. The mattress assembly of example 44, wherein the drape includes a zipper on the cover extension operable to secure the free margins above the panel and to mutually disengage the free margins.

46. The mattress assembly of any one of examples 41-45, wherein the drape is attached to the top panel at a tape edge located proximate a bottom perimeter of the top panel.

47. The mattress assembly of any one of examples 41-46, wherein the drape has first margin and a second margin, and further includes a border skirt attached at a first margin to the top panel and extending therefrom, the border skirt being movable, with the drape, from the cover facing of the top panel.

48. The mattress assembly of example 46, wherein the cover facing includes a tape edge proximate the topside and a tape edge proximate the underside.

49. The mattress assembly of any one of examples 41-48, wherein drape is extended vertically and about the cover facing.

50. The mattress assembly of any one of examples 41-49, wherein the drape further includes a tape edge defining a margin interface of the border and the cover extension.

51 The mattress assembly of any one of examples 50, wherein the cover is detachable so that the drape is pivotable, about a tape edge joining the drape with the panel, away from the top side and the top panel.

52. The mattress assembly of example 41, wherein the top panel assembly includes at least two or three tape edges, including a first tape edge joining the drape with the top panel, and (i) a second tape edge positioned about said cover facing in spaced apart relation with the first tape edge, and/or (ii) a third tape edge positioned about the drape in spaced apart relation with the first tape edge and the top panel.

53. A method of forming a mattress comprising the steps of:

providing a cover-cushion compact including a top panel having one or more filler layers and a drape affixed to the top panel about a first margin and secured outboard of said first margin about said top panel;

disengaging the drape from about said panel; and while remaining affixed to the top panel about a first margin, extending said drape to engage a supporting core, thereby completing the mattress assembly.

54. The method of example 53, wherein said engaging a core includes securing the drape about the core.

55. The method of example 53 or 54, wherein said engaging the core further includes encasing the core with said compact.

56. The method of example 53, 54, or 55, further comprising detachably fastening sections of the drape, outboard of said first margin, to enclose the drape about the top panel.

57. The method of example 53, 54, 55, or 56, further comprising detaching said fastening sections to open the drape.

58. The method of any one of examples 53-57, wherein said extending includes inverting said drape to engage the core.

59. The method of example 58, wherein said inverting includes securing the drape about said core.

60. The method of any one of examples 58-59, wherein said first margin is affixed to said top panel at a fixed edge, said inverting including pivoting said drape about said fixed edge.

61. The method of any one of examples 58-60, wherein said inverting incudes encasing said core.

62. The method of any of examples 58-61, wherein said inverting includes receiving said core in a compartment defined by the compact.

63. The method of any one of examples 58-62, wherein said drape includes a border skirt, said providing said compact includes supporting said border skirt about said top panel and said inverting includes pivoting said border skirt toward said core.

64. The method of example 63, wherein said inverting includes pivoting said border skirt to said core and supporting said border skirt about said core.

65. The method of any one of example 53-64, wherein said top panel includes a topside and sidewalls, and said providing said compact includes situating said drape about said panel such that said compact covers said sidewalls and topside of said top panel.

66. The method of any one of examples 53-65, wherein said compact is affixed to said top panel about a first tape edge and said top panel further includes a second tape edge and said drape includes a third tape edge, and wherein said engaging said core is preceded by pivoting said compact about said first tape edge toward said core so as to reveal the second tape edge, and dispose said third tape edge about a perimeter of said core.

67. The method of any one of example 53-66, wherein said providing includes providing a drape having a first end defined by said first margin and a second end defined by a second margin, said drape having continuous sidewalls extending between said margins, said drape being situated such that said first margin enwraps said top panel and said second margin is closed such that said drape encloses at least a topside and sidewalls of the top panel.

68. The method of any one of examples 53-67, wherein said engaging said core includes pivoting said drape away from said top panel and toward and about said core to substantially encase said core.

69. The method of any one of examples 56-68, wherein said drape and said panel together include at least two tape edges, said detachably fastening step including covering said at least two tape edges, and said engaging said core includes uncovering said tape edges.

70. The method of any one of examples 56-69, wherein said drape and said panel together include at least three tape edges, said detachably fastening step including pivoting said drape toward said panel such that at least two of said tape edges are covered.

71. The method of any one of examples 56-70, wherein each of said drape and said top panel includes at least one tape edge, said detachably fastening includes covering said at least one tape edges, and said engaging said core is preceded by uncovering said at least one tape edges by moving said drape about said fixed margin and away from said top panel.

72. The method of any one of examples 56-70, wherein said drape and said top panel share at least a first tape edge and each of said drape and top panel further include another tape edge, said detachably fastening including covering said first tape edge and both of said another tape edge, and said engaging said core is preceded by uncovering said tape edges by moving said drape about said fixed margin and away from said top panel.

73. The mattress, mattress assembly, compact, mattress assembly, or other mattress component referred to in any of examples 1-72, which includes a first tape edge affixing, attaching, or engaging, about a perimeter edge, a top panel or cushion assembly to a drape extending therefrom and optionally, a second tape edge affixing, attaching, or engaging a border skirt of the drape to a core underside cover about a bottom perimeter edge of the core and, optionally, a top tape edge located about a top perimeter of the top panel or cushion assembly.

74. The present description also applies to methods of making, forming, or assembling each of the products, mattress assemblies, and sub-assemblies described above in Examples 1-15, 31-40, 41-52, and 73—as further examples of applications, variations, and embodiments.

75 The present description also applies to the products resulting from the methods of making, forming, or assembling described above in Examples 16-30 and 53-74—as further examples of applications, variations, and embodiments.

The foregoing has been presented for purposes of illustration and description. These descriptions are not intended to limit the disclosure or aspects of the disclosure to the specific mattress or mattress component constructions or articles, apparatus and processes disclosed. Various aspects of the disclosure are intended for applications other than the finished mattress referred to above. Certain manufacturing techniques and structural features and designs described may also be incorporated into or with other mattress designs, and other furniture pieces incorporating fabrics and layers, assemblies, or combinations thereof. The mattress assembly may also incorporate different components in alternate designs according to the present description. These and other variations of the disclosure will become apparent to one generally skilled in the relevant consumer product art provided with the present disclosure. Consequently, variations and modifications commensurate with the above teachings, and the skill and knowledge of the relevant art, are within the scope of the present disclosure. The embodiments described and illustrated herein are further intended to explain best or preferred modes for practicing the disclosure, and to enable others skilled in the art to utilize the disclosure and other embodiments and with various modifications required by the particular applications or uses of the present disclosure.

While specific embodiments and equipment are shown and described herein, one skilled in the art would understand that the methods, systems, and apparatus disclosed herein are not limited to these particular embodiments described.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A mattress assembly comprising:

a support core mattress component including a core having a topside, underside, and all-around side construction therebetween; and a cushion assembly mattress component including a plurality of filler layers secured within a layered cushion top panel;

wherein a first of the mattress components further includes a drape having a fixed margin secured to the top panel, and a free margin secured to the support core mattress component;

wherein said drape is secured about a bottom perimeter of the top panel and pivotable thereabout; and wherein the top panel includes a vertical facing extending from the bottom perimeter to a top perimeter, the drape being pivotable about the bottom perimeter to cover and uncover said vertical facing.

2. The mattress assembly of claim 1, wherein said drape is attached to the top panel at a tape edge about the bottom perimeter and extended therefrom to encase the support core mattress component.

3. The mattress assembly of claim 2, wherein said drape is extended over the support core mattress component to encase the support core mattress component.

4. The mattress assembly of claim 1, wherein the top panel of the cushion assembly mattress component includes said filler layers and at least two tape edges each closing edges about a perimeter of the top panel, said drape extending from said top panel and about said sidewalls of said core to engage a border skirt thereabout.

5. The mattress assembly of claim 4, wherein said drape further includes a cover extending from said border skirt and enclosing said underside of the core.

6. The mattress of claim 5, wherein said cover includes detachably fastenable free margins that are united beneath said core to encase said core with said cushion assembly mattress component.

7. The mattress assembly of claim 6, wherein said cover includes a fastener;

wherein said free margins are fastened together with said fastener; and wherein the drape includes a lower tape edge movable therewith and an upper tape edge affixing the drape to the top panel, and a top panel tape edge affixes a top perimeter of the facing to the top panel, wherein the drape covers the tape edge when secured about the top panel and the lower tape edge is aligned about a bottom perimeter of the core when the core is encased by the drape.

8. The mattress assembly of claim 1, wherein said support core mattress component includes a border skirt extending between said top side and said underside, said drape further including an upper tape edge defining an upper margin of said border skirt and a lower tape edge defining a lower margin of said border skirt; and wherein said drape is joined with said border skirt at said upper tape edge.

9. The mattress of assembly of claim 8, wherein said drape further incudes a cover extension interfaced with the border skirt at a tape edge and extending beneath the core to enclose the core.

10. A mattress top panel subassembly for engagement with a support core to complete a finished mattress assembly, said top panel subassembly comprising:

a top panel containing a plurality of filler layers, the top panel having a topside, an underside, and an all-around vertical cover facing extending between a perimeter of the topside and a perimeter of the underside; and a drape extending from the top panel proximate the perimeter of the top panel underside to a free margin pivoted toward the topside and detachably fastened thereabout and;

wherein said drape is secured about a bottom perimeter of the top panel and pivotable thereabout; and wherein the drape is pivotable about the bottom perimeter to cover and uncover said vertical cover facing.

11. The mattress subassembly of claim 10, wherein said drape includes a cover extension extending inwardly of the top perimeter and over said topside.

12. The mattress subassembly of claim 11, wherein said cover extension includes free margins that are detachably united above said top panel.

13. The mattress subassembly of claim 11, wherein said cover extension covers said topside; and a bottom perimeter tape edge securing the drape about the bottom perimeter of the top panel, a movable tape edge disposed about the drape in a movable section of the drape and in between said free margins and said bottom perimeter tape edge, and a top panel tape edge securing a top perimeter edge of the vertical facing about the perimeter of the top side of the top panel, wherein the movable tape edge is movable with the movable section.

14. The mattress subassembly of claim 13, wherein said drape includes a zipper on said cover extension operable to secure the free margins above the panel and to mutually disengage the free margins.

15. A method of forming a finished mattress comprising the steps of:

providing a mattress core and a cover-top panel compact that includes a top panel having one or more filler layers and a drape that is affixed to the top panel and has movable bottom section;

securing the drape such that the drape at least partially covers the cover-top panel, and sidewalls of the top panel including an all-around vertical cover facing extending from a top perimeter of the top panel compact to at least a bottom perimeter of the top panel;

moving the movable bottom section of the drape from about the top panel to engage the movable bottom section about the core, thereby integrating the core with the cover-top panel compact to form the finished mattress and uncovering the sidewalls to expose the vertical facing of the top panel of the finished mattress.

16. The method of claim 15, wherein said moving includes inverting the drape to engage the supporting core, thereby completing the finished mattress.

17. The method of claim 16, wherein said securing includes disposing the drape about the top panel by detachably engaging free margins of the movable bottom section of the drape above the top panel and wherein the drape is secured to a perimeter of the top panel about a tape edge.

18. The method of claim 15, wherein said securing the drape incudes detachably attaching free margins of said movable section of said drape about the top panel and said moving is preceded by detaching said detachably attached free margins.

19. The method of claim 18, wherein said moving is preceded by opening the drape to detach the free margins.

20. The method of claim 15, wherein the drape incudes three tape edges including one secured about a top perimeter of the top panel during the securing step and in the finished mattress and a second tape edge secured about a bottom perimeter of the top panel during the securing step and in the finished mattress, whereby the vertical facing extends between said first and second tape edges.

21. The method of claim 15, wherein the drape includes a tape edge secured about a bottom perimeter of the top panel during the securing step and in the finished mattress, whereby the vertical facing extends between the tape edge and a top perimeter of the top panel, said moving step including pivoting the drape about the tape edge secured about the bottom perimeter of the top panel thereby uncovering the vertical facing.

22. The method of claim 15, wherein the drape includes three tape edges positioned about the drape in spaced apart relation, wherein said moving step includes pivoting the drape about the top panel to integrate the core whereby a first tape edge is aligned about a top perimeter of the top panel, a second tape edge is aligned and secured about a bottom perimeter of the top panel adjacent the core with the vertical facing extending between the top and bottom perimeters, and the third tape edge located about the core spaced away from the top panel.

* * * * *